United States Patent [19]

Chapman

[11] 4,144,594

[45] Mar. 20, 1979

[54] FILIGREED BELT AND METHOD OF MAKING SAME

[76] Inventor: Melvin H. Chapman, P.O. Box 57, Nocona, Tex. 76255

[21] Appl. No.: 891,139

[22] Filed: Mar. 28, 1978

[51] Int. Cl.[2] ..... A41F 9/00

[52] U.S. Cl. ..... 2/338; 69/2

[58] Field of Search ..... 2/338, 336, 340, 243 R, 2/311, 339; 69/2; 101/3 R; 428/473

[56] References Cited

U.S. PATENT DOCUMENTS

| | | | |
|---|---|---|---|
| 1,848,821 | 3/1932 | Blakely | 69/2 |
| 2,014,263 | 9/1935 | Messmer | 428/473 X |
| 2,427,119 | 9/1947 | Bensel | 2/338 |
| 2,494,262 | 1/1950 | Pease, Jr. | 2/338 |
| 2,513,886 | 7/1950 | Mix | 2/338 |

*Primary Examiner*—H. Hampton Hunter

*Attorney, Agent, or Firm*—Wayland D. Keith

[57] ABSTRACT

A leather product decorated with predetermined indicia and a method of making the product. Preferably, a leather belt is provided with a liner attached thereto along a predetermined section of the rear of the belt to define a pocket. Decorative indicia such as letters, symbols, or the like are then marked on the belt immediately opposite the liner. A resistant cutting strip inserted into the pocket facilitates filagreeing by enabling spaces between the marked indicia to be removed through cutting or chiseling without damaging the belt. After unwanted material between the desired decorative indicia has been removed through filigreeing, the cutting strip may be simply removed from the pocket. In a preferred embodiment of the invention the decorative indicia may be colored prior to removal of the liner, and/or a background strip of predetermined color may be drawn into the pocket as the liner is removed to highlight the filigreed decoration.

18 Claims, 7 Drawing Figures

FILIGREED BELT AND METHOD OF MAKING SAME

BACKGROUND OF THE INVENTION

This invention relates generally to leather crafts. More particularly, the present invention relates to a method of filigreeing leather belts or the like with predetermined decorations such as letters, numerals or the like.

In recent years leather goods have become increasingly popular. For example, finely crafted leather belts, boots, purses and the like have become in great demand. As will be recognized by those skilled in the art, it has become increasingly well known or popular to provide leather products with distinctive personalized designs including various symbols, logos, words, numbers or the like. Decoration may be accomplished through the relatively common techniques of burning, stamping, inking or painting. Designs also may be cut into leather through a technique known as filagreeing during the manufacturing process. In recent years a trend has been developing whereby the retail consumer seeks and demands individually personalized leather goods which include distinctive markings or designs of his own choosing. Usually the leather goods dealer resorts to a variety of already mentioned well known techniques to provide the consumer with his own individual design. Custom work of this nature usually must be done at the retail store, and to please the consumer the work should be done quickly and efficiently. In most cases where a distinctive design comprised of letters, numbers or the like is desired, it is simply stamped or inked onto the leather product by various stamps or dyes. Alternatively the desired design may be provided on leather products by conventional burning techniques as desired by the consumer.

It is known in the art to "filigree" various designs, logos or indicia onto leather products. The filigree process normally involves the use of a hammer or mallet and cutting implement (such as a chisel or the like) and the desired indicia is either chopped out of the leather product or alternatively spaces between the desired indicia may be removed so that the desired indicia comprise separate entities. However, conventional leather craft filigreeing may be extremely time consuming, and unless done with great care by the craftsman can easily ruin or damage the leather product. For the latter reasons the filagree process has been practiced at the manufacturing facility rather than at the retail store. In light of the great care which must be used with conventional filigreeing techniques it can be exceedingly difficult to provide the consumer with the desired leather customized product within reasonable time limits and for a reasonable purchase price.

It is known in the art to provide leather goods (such as a belt, etc.) with insertable, color display members to highlight the pre-cut designs such as lettering and the like. U.S. Pat. No. 2,427,119 is representative of the latter technique.

SUMMARY OF THE INVENTION

The present invention comprises a method for decorating a leather product. More particularly, the invention encompasses an improved process for filigreeing a leather product, and a leather belt produced through the process described.

In the instant invention a leather product including a belt or the like may be provided with customized decorations through the filigree process in an efficient and economical manner. The belt, or other leather product to be decorated, is first provided with a rear liner which may be attached thereto by sewing or the like. The desired decorative indicia is first marked on the belt or leather product through a conventional techniques immediately over the liner. A preferably formica cutting strip is placed in the pocket between the liner and the leather product to facilitate the filigree cutting process. Decorative indicia which may be marked on the belt are then formed by cutting and removing material between the various indicia with a mallet and cutting tool such as a chisel or the like, damage being prevented to the belt by the cutting strip. When the desired decorative indicia are properly filigreed, they may first be dyed or colored as desired by the consumer. The cutting strip may then be removed from the pocket so that the background of the colored indicia is provided by the leather product itself. Alternatively, in a preferred form of this invention, a separate background strip of predetermined color may be attached with a linkage strip to the cutting strip, so that the cutting strip will pull the background strip into the pocket when the cutting strip is removed. In this manner a desired background color may be selected by the consumer to provide the individual contrast between the filigreed decorations and the rest of the belt material. Importantly, the aforementioned process may conveniently be practiced at the retail level, or by the consumer himself, and is not limited to the initial manufacturing stages of production.

Thus, a broad object of this invention is to provide a decorative filigree process for decorating leather items such as belts or the like.

A related object of this invention is to provide a method for filigreeing leather products which may be carried out quickly and inexpensively by the retail leather craftsman or consumer.

Another object of this invention is to provide a method of filigreeing decorations upon a leather product which may be practiced with inexpensive, conventional leather working tools.

Still another object of the invention is to provide a decoration technique for use in the leather crafts which may be adapted towards decorating a wide variety of insignias, letters, numbers, trademarks, or other desired indicia as quickly and as inexpensively as possible.

A still further object of this invention is to provide a novel method for decorating leather products such as belts which may be practiced at the retail store or by the ultimate consumer without damaging, the product.

Yet another object of this invention is to provide a belt decorated through the filigree process as described.

These and other objects and advantages of this invention, along with features of novelty appurtenant thereto, will appear or become apparent in the course of the following description.

BRIEF DESCRIPTION OF THE DRAWINGS

In the following drawings, which form a part of the specification and which are to be construed in conjunction therewith, and in which like reference numberals have been employed throughout to indicate like parts in the various views.

DETAILED DESCRIPTION OF THE DRAWINGS

Figure 1:
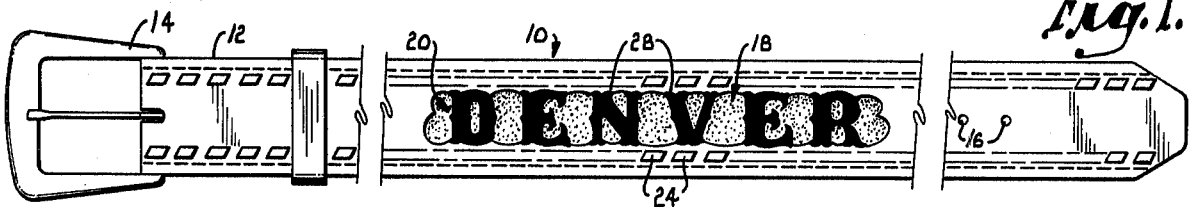
FIG. 1 is a plan view of a belt constructed in accordance with the teachings of this invention and with parts thereof broken away for clarity.

With initial reference to FIG. 1., there is illustrated a leather product in the form of a belt 10 which includes an elongated strip-like body 12 provided with a conventional belt buckle 14 for fastening the belt to buckle holes 16 in a conventional manner. It should be appreciated at the outset that a belt is illustrated for purposes of disclosure, and that the process to be described herein may be applied to a variety of preferably leather goods with equal utility. With additional reference to FIGS. 2 and 3 thereshown is an area 18 of predetermined length on the belt 10 on which a decorative design 20 comprising a plurality of individual letters or indicia is to be applied. The process described facilitates the application of a variety of designs, including logos, numerals, various styles of letters, symbols, designs and the like. For illustration purposes the word "DENVER" is shown.

Figure 2:
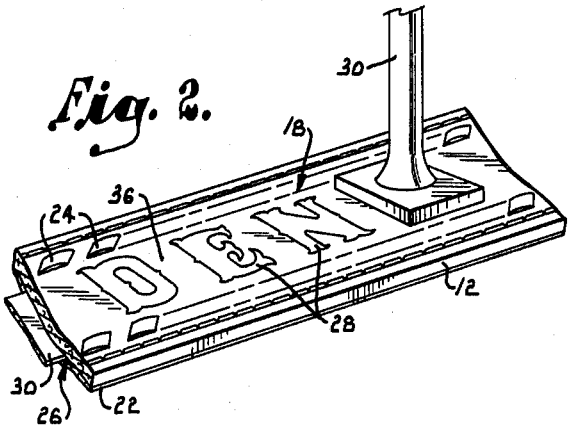
FIG. 2 is an enlarged, perspective view of the front area of a belt which is to be decorated through the process described herein, illustrating the preliminary inking or marking stage of the process.
Figure 3:
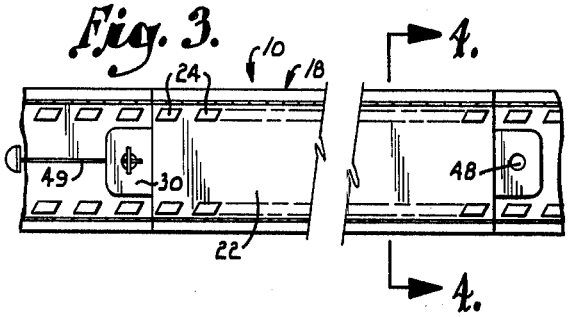
FIG. 3 is a view of the rear or underside of the belt shown in FIG. 2 with parts thereof broken away for clarity and showing the pocket-defining liner and the cutting strip preferably inserted therewithin.
Figure 4:
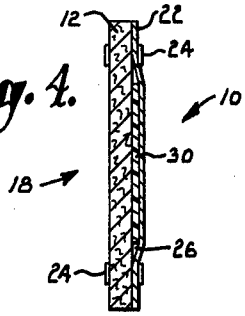
FIG. 4 is a sectional view of the belt taken through line 4—4 in FIG. 3.

In FIG. 3 it is seen that at the rear of the belt 10 (opposite area 18) a liner 22 of length approximately equal to the length of area 18 is attached to the belt via stitches 24. Alternatively, liner 22 could be attached through riveting, glueing or the like, as long as the pocket 26 (FIG. 4) defined between the liner and the belt underside (FIG. 3) remains unobstructed. Before commencing the process to be described it has been found desirable that a preferably formica cutting strip 30 be placed within pocket 26 (between the liner and the belt body portion) so that the strip is positioned underneath area 18, upon which design 20 is located. As seen in FIG. 2 the various letters or other indicia 28 forming design 20 may be first marked on the surface 18 with the use of an inked, leather impression stamp 30 of conventional construction. Stamps of this nature are well known in the art and will not be described in detail. It will of course be apparent to those skilled in the art that the design 20 may be sketched onto the belt by hand, or may be marked with a leather burning pencil or the like.

Figure 5:
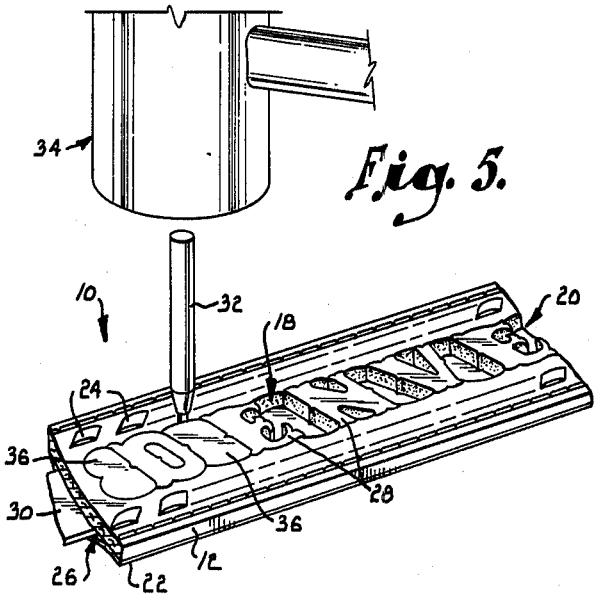
FIG. 5 is a perspective, diagrammatic view showing how the filigree process is preferably completed.

Once the letters or other desired indicia are marked, the spaces between the various characters are preferably cut out, as illustrated in FIG. 5. FIG. 5 illustrates the filigree process, whereby, through the use of a conventional chisel or cutting tool 32 and a conventional mallet or hammer 34 material in the spaces between and around the various letters 28 may be removed. Importantly, it will be observed that through the cutting process illustrated in FIG. 5 the cutting strip 30 immediately underneath the design 20 (area 18) will prevent damage to the belt inasmuch as it will absorb impacts of chisel 32. In this manner a typical section 36 of leather which is to be cut away through the chiseling process will be more easily removed, in that cutting and separation of the leather fiber, for example, will be facilitated when the chisel 32 is driven into abutment with cutting surface 30.

Figure 6:
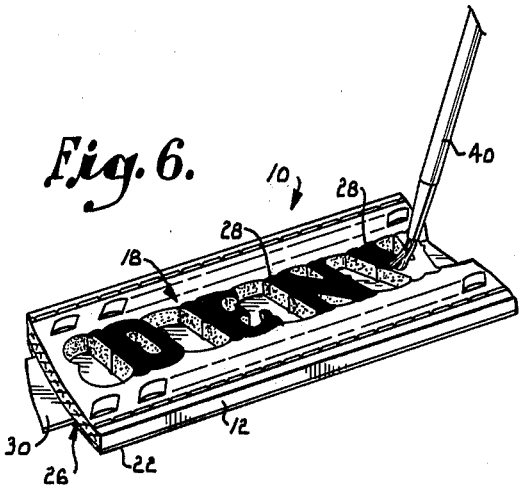
FIG. 6 is a perspective, diagrammatic view illustrating the optional step of dyeing or coloring the filigreed indicia.
Figure 7:
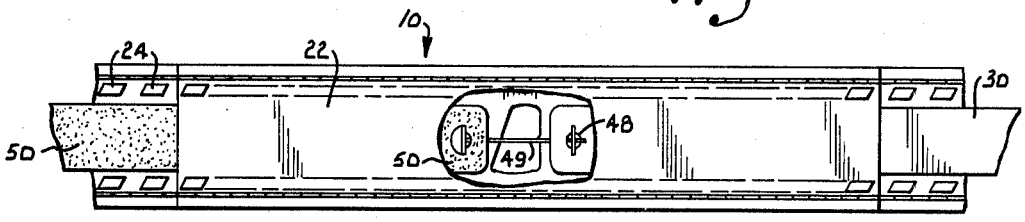
FIG. 7 is a diagrammatic view with parts thereof broken away or shown in section for clarity illustrating how an optional background strip may be drawn into the pocket as the cutting strip is removed therefrom.

When the filigree cutting process illustrated in FIG. 5 is completed, individualized, three dimensional letters spelling "DENVER" will be plainly visible. In order to contrast the letters with the color of the belt they may be dyed or colored as illustrated in FIG. 6. Each of the letters 28 in FIG. 6 may first be dyed or hand-painted with a conventional brush 40. It will be apparent that because of the presence of cutting strip 30 the painting process will be facilitated since excess paint will smear strip 30 rather than contacting the inner portions of the belt. After the dye or paint is allowed to dry the cutting strip 30 may be removed from the pocket 26 simply by grasping it and drawing it therefrom, (FIGS. 3, 7).

Importantly, cutting strip 30 may preferably be provided with a hole 48 which may receive a wire or string 49 to link the strip 30 to a background strip 50. As best illustrated in FIG. 7, upon removal of cutting strip 30 the background strip 50 will be drawn into pocket 26 to highlight the letters 28 or to otherwise provide the desired contrast or aesthetic effects. The colors used of course would depend upon the matter of individual choice. With black letters a white-colored background strip, for example, would provide a high degree of contrast. If colored strip 50 is withdrawn from the pocket 26 a different colored strip may be quickly drawn into the pocket to provide alternative coloration.

It will be readily apparent to those skilled in the art that the foregoing technique may be readily applied to a variety of leather or other products, moreover it will be apparent that the process described may be readily practiced at the retail level, so that individual customers can quickly be provided with personalized design and/or color schemes.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method of decorating a leather product with predetermined indicia, said method comprising the steps of:

forming a pocket at a predetermined portion of the rear of said product by attaching a liner thereto;

marking said indicia on the front of the leather product in an area thereon over said pocket which is to be decorated;

inserting a cutting strip into said pocket between said leather product and said liner thereby forming a cutting surface for preventing damage to said leather product; and filigreeing said area which is to be decorated by removing material between each of said indicia formed in said marking step.

2. The method as defined in claim 1 including the step of coloring said indicia after said filigreeing step.

3. The method as defined in claim 2 including the step of removing said cutting strip from said pocket after said coloring step.

4. The method as defined in claim 3 including the steps of:

attaching a background strip to said cutting strip prior to removal of said cutting strip; and pulling said background strip into said pocket as said liner is removed from said pocket to provide a background of predetermined color for said filigreed indicia.

5. The method as defined in claim 1 including the step of removing said cutting strip from said pocket after said filigreeing step.

6. The method as defined in claim 5 including the steps of:

attaching a background strip to said cutting strip prior to removal of said cutting strip; and pulling said background strip into said pocket as said liner is removed from said pocket to provide a background for said filigreed indicia.

7. A method of decorating a belt with predetermined indicia, said method comprising the steps of:

forming a pocket at a predetermined portion of the rear of said belt by attaching a liner to said predetermined rear portion, the length of said liner substantially equal to the length of that portion of the belt which is to be decorated;

marking said indicia on the front of said belt over said pocket in an area thereon which is to be decorated;

inserting a cutting strip into said pocket between said belt and said liner to form a cutting surface for preventing damage to said belt; and filigreeing said area which is to be decorated by removing material between each of said indicia formed in said marking step.

8. The method as defined in claim 7 including the steps of coloring said indicia after said filigreeing step.

9. The method as defined in claim 8 including the step of removing said cutting strip from said pocket after said coloring step.

10. The method as defined in claim 9 including the steps of:

attaching a background strip to said cutting strip prior to removal of said cutting strip; and pulling said background strip into said pocket as said liner is removed from said pocket to provide a background of predetermined color for said filigreed indicia.

11. The method as defined in claim 7 including the step of removing said cutting strip from said pocket after said filigreeing step.

12. The method as defined in claim 11 including the steps of:

attaching a background strip to said cutting strip prior to removal of said cutting strip; and pulling said background strip into said pocket as the said liner is removed from said pocket to provide a background for said filigreed indicia.

13. A belt decorated with predetermined indicia through the steps of:

forming a pocket at a predetermined portion of the rear of said belt by attaching a liner to said predetermined rear portion, the length of said liner substantially equal to the length of that portion of the belt which is to be decorated;

marking said indicia on the front of said belt in an area thereon over said pocket which is to be decorated;

inserting a cutting strip into said pocket between said belt and said liner to form a cutting surface for preventing damage to said belt; and filigreeing said area which is to be decorated by removing material between each of said indicia formed in said marking step.

14. The belt as defined in claim 13 decorated through the additional step of coloring said indicia after said filigreeing step.

15. The belt as defined in claim 14 decorated through the additional step of removing said cutting strip from said pocket after said coloring step.

16. The belt as defined in claim 15 decorated through the additional steps of:

attaching a background strip to said cutting strip prior to removal of said cutting strip; and pulling said background strip into said pocket as said liner is removed from said pocket to provide a background of predetermined color for said filigreed indicia.

17. The belt as defined in claim 13 decorated through the additional step of removing said cutting strip from said pocket after said filigreeing step.

18. The belt as defined in claim 17 decorated through the additional steps of:

attaching a background strip to said cutting strip prior to removal of said cutting strip; and pulling said background strip into said pocket as said liner is removed from said pocket to provide a background for said filigreed indicia.

* * * * *